United States Patent [19]

Martin et al.

[11] Patent Number: 4,876,885

[45] Date of Patent: Oct. 31, 1989

[54] RAILROAD COUPLER MOUNT

[75] Inventors: Gregory C. Martin; Gary W. Egerton, both of Montgomery County, Md.

[73] Assignee: Pulse Electronics, Inc., Rockville, Md.

[21] Appl. No.: 221,352

[22] Filed: Jul. 19, 1988

[51] Int. Cl.[4] ..... G01L 5/28

[52] U.S. Cl. ..... 73/129

[58] Field of Search ..... 73/129; 246/167 R; 213/75 R, 76, 77, 78, 79, 98, 99, 1 R

[56] References Cited

U.S. PATENT DOCUMENTS

| | | |
|---|---|---|
| 2,355,544 | 8/1944 | McGowan . |
| 3,025,973 | 3/1962 | Shafer . |
| 3,587,868 | 6/1971 | Yates . |
| 4,487,060 | 12/1984 | Pomeroy . |
| 4,520,662 | 6/1985 | Schmid . |
| 4,592,217 | 6/1986 | Fernandez et al. . |
| 4,691,563 | 9/1987 | Martin . |

*Primary Examiner*—Stewart J. Levy
*Assistant Examiner*—Robert R. Raevis
*Attorney, Agent, or Firm*—Whitham and Marhoefer

[57] ABSTRACT

An improved railroad coupler mount (18) secures end of train signalling and monitoring equipment (40) to the coupler head (10) of the last car in a train. The coupler mount (18) is secured to the coupler head (10) by a banana shaped arm (20) which extends through relief holes (14*a* and 14*b*) in the guard arm side (12) of the coupler. A swivel toggle (22) positioned at the end of the arm (20) is pivoted to a perpendicular orientation relative to the arm (20) after it has been inserted through the relief holes (14*a* and 14*b*). A tightening screw (28) turned by knob (26) draws the arm (20) back out of the relief holes (14*a* and 14*b*) and causes the swivel toggle (22) to bear against the sidewall of the coupler head (10). A bulge (38) in the arm (20) is braced tightly against an inside wall of the coupler head (10) after tightening the arm (20). The coupler mount (18) includes a locking bar (52) for simultaneously locking a battery compartment door (50) on the equipment box (40) and locking the coupler mount (18) to the coupler head (10). The battery compartment door (50) is kept closed by an upwardly extending portion (58) of a rotating flange (56) positioned on one end of the locking bar (52). The coupler mount (18) is secured to the coupler head (10) by the bent end of the locking bar (52) being pivoted to an interfitting engagement with spokes (52) of the knob (26) after the banana arm (20) has been tightened. A pad (70) and V-jaws (72 and 74) positioned on the side of the mount provide stability.

11 Claims, 4 Drawing Sheets

FIG. 1
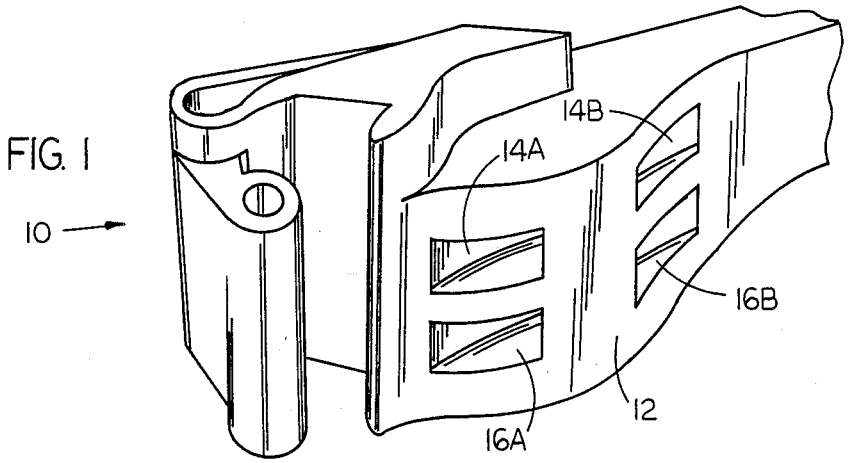
FIG. 2
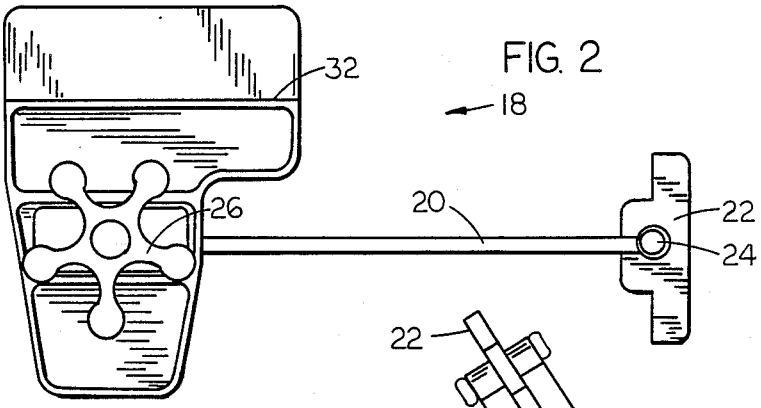
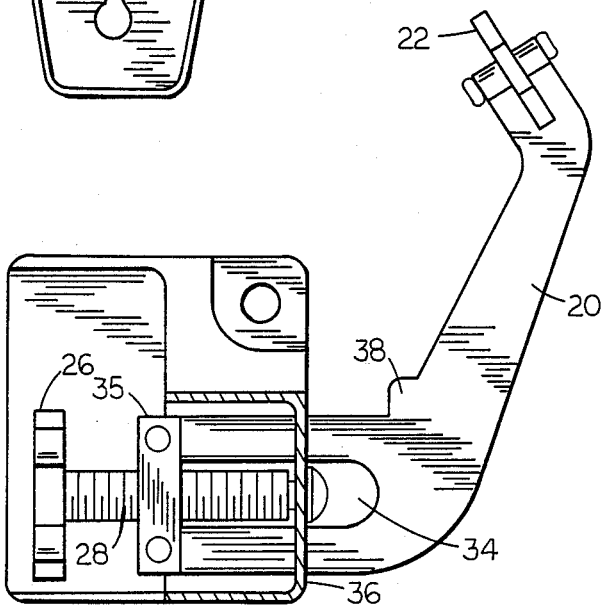
FIG. 3

RAILROAD COUPLER MOUNT

BACKGROUND OF THE INVENTION

1. Field of the Invention

The invention is generally directed towards improvements in an apparatus for mounting marker light and telemetry equipment to railroad cars, and more particularly, to an improved apparatus for securing equipment to the guard arm side of a coupler head on the last car in a train wherein the apparatus includes a means for simultaneously locking the equipment to the coupler head and locking a compartment door on the equipment.

2. Description of the Prior Art

The preferred method for meeting modern railroad operating and safety requirements is by using end of train monitoring and signalling equipment mounted on the last car in a train. The equipment typically monitors brake line pressure, and may also monitor train movement and train light operation, as well as a variety of other variables. The monitored information is then transmitted to the head of the train by a battery powered telemetry transmitter. In addition to its monitoring functions, the equipment provides a marker light which identifies the end of the train. The light must be positioned a certain height above the track and meet certain dispersion characteristics as required by governmental regulations.

Several methods for securing end of train signalling and monitoring equipment to the coupler head of the last car in a train have been devised. U.S. Pat. No. 2,355,544 to McGowan and U.S. Pat. No. 4,487,060 to Pomeroy show signalling and monitoring equipment positioned within the coupler opening. The problem with this arrangement is that the coupler containing the equipment cannot mate with a coupler on another railroad car without damaging the equipment. Moving trains around in an active yard can often lead to damaged equipment simply because railroad personnel have forgotten to remove the equipment from the coupler. Moreover, a pusher locomotive cannot be connected to the rear of the train without having to remove the signalling and monitoring equipment first.

The problem of avoiding accidental damage was addressed in U.S. Pat. No. 4,592,217 to Fernandez et al which shows the signalling and monitoring equipment mounted on the top surface of the coupler head. In the Fernandez et al patent, the supporting frame includes an integral rod which extends through the flag hole in a railroad coupler. Hence, two cars can be coupled without any damage to the equipment. However, not all couplers are fabricated with a flag hole and, therefore, the Fernandez et al mount cannot be used on all railroad cars.

The guard arm side of a coupler head is generally fabricated with four relief holes. The relief holes facilitate the casting of the coupler head and lighten the coupler. U.S. Pat. No. 4,520,662 to Schmid discloses a coupler mount which includes a pair of jaws that are clamped to the four relief holes of a coupler head. The coupler mount is installed on a coupler head by inserting two pairs of parallel jaw members into the relief holes and drawing the jaw members together by rotation of a rod. The Schmid mount allows the coupler head on which it is mounted to be mated to another train's coupler without damage to the signalling and monitoring equipment positioned on the mount; however, the Schmid mount is expensive to manufacture and is difficult for one man to attach to a railroad car coupler head.

In U.S. Pat. No. 4,691,563 to Martin, a railroad coupler mount which utilizes two of the four relief holes in the guard arm side of a coupler head is disclosed. The mount comprises a banana shaped arm member which extends through two relief holes that are on a common horizontal axis. A padlock is secured through a portion of the arm which projects from the relief holes at a first end. The mount is then tightened against the coupler head by a screw clamp arrangement positioned at the second end of the arm which draws the arm back out of the relief holes until the padlock is tightly braced against the guard arm side of the coupler head.

SUMMARY OF THE INVENTION

It is an object of this invention to provide an improved railroad coupler mount for securing end of train signal light and monitoring equipment to the guard arm side of a coupler head on the last car in a train.

It is another object of this invention to provide a coupler mount which includes a means for simultaneously locking a battery compartment door on the signal light and monitoring equipment and locking the coupler mount to the railroad coupler.

According to the invention, several improvements have been made upon the railroad coupler mount disclosed in U.S. Pat. No. 4,691,563 to Martin. Improvements have been made in the means for bracing the mount against the inside wall created by the relief holes in the railroad coupler head, the means for tightening the mount against the guard arm side of the coupler head, and the means for securing the train signal light and monitoring equipment to the mount. In addition, a new locking means has been provided which allows for simultaneously locking the train signal light and monitoring equipment to a coupler head and locking a battery compartment door on the signal light and monitoring equipment.

The improved railroad coupler mount includes a banana shaped arm member which extends through two relief holes on a common horizontal axis in the guard arm side of a coupler head. A bulge formed integrally with the arm braces the arm tightly against the inside wall of the coupler head. A first end of the arm member includes a swivel toggle which is pivotable from an in-line orientation with the arm to a perpendicuar orientation. When the arm of the railroad coupler mount is being passed through the relief holes, the swivel toggle is in-line with the arm such that it may easily pass through the relief holes in the coupler head. After the arm has passed through the relief holes, the toggle is pivoted to a perpendicular orientation that allows the toggle to bear firmly against the sidewall of the coupler head when the mount is tightened. A second end of the arm member is equipped with a screw mechanism for tightening the banana shaped arm to the guard arm side of the coupler head. The screw mechanism withdraws the arm member from the relief holes to a point at which the swivel toggle tightly engages the sidewall of the coupler head and the bulge on the arm is firmly braced against the inside wall of the coupler head. A knob is provided for easy rotation of the screw.

The train signal light and monitoring equipment is attached to the mount by suitable fasteners, such as nut and bolt combinations. Various types of fasteners which allow for the occasional separation of the railroad coupler mount from the train signal light and monitoring equipment could be used; however, it is seldom necessary to remove the railroad coupler mount from the equipment because they are used together. The need to separate the two pieces is generally confined to the times when the train signal light and monitoring equipment requires service, thus allowing the railroad coupler mount to be used with replacement signalling and monitoring equipment. A handle connected to the side of the train signal light and monitoring equipment permits railroad personnel to carry the two pieces together as a single unit.

A pivotable locking mechanism is positioned such that when it is placed in the locked position, the battery compartment door on the train signal light and monitoring equipment is locked and the knob connected to the tightening screw is secured. The locking mechanism comprises a bar with a bent first end and a rotating flange element connected to a second end. The bent first end fits between the spokes of the knob in the locked position, thereby preventing the knob from being rotated. In the unlocked position, the bent first end is pivoted away from the knob and allows free rotation of the knob. The rotating flange element connected at the second end of the bar is angled and has a first side which is parallel to and in close proximity with the battery compartment door and has a second side which projects outwardly from the monitoring equipment. The first side of the flange element has a portion which extends above the bottom edge of the battery compartment door when the locking bar is placed in the locked position. The second side of the flange element has an aperture therethrough. The aperture is aligned with an aperture in an outwardly projecting tab connected to the train signal light and monitoring equipment. A padlock extends through the two apertures andsecures the locking bar of the improved railroad coupler mount in the locked configuration. In the unlocked configuration the locking bar is pivoted such that the flange element at the second end of the locking bar hangs downwardly. The batery compartment door can be easily opened because no part of the flange overlaps the bottom edge of the battery compartment door in this position.

The coupler mount is first tightened against the guard arm side of the coupler head before the first bent end of the locking bar is pivoted to inhibit rotation of the knob. The mount together with the train signal light and monitoring equipment cannot be unlawfully removed from the train after being locked because the swivel toggle cannot be pivoted and, therefore, the arm of the mount may not be withdrawn from the relief holes in the guard arm side of the coupler head.

A set of jaws and pad arrangement positioned on the side of the coupler mount which contacts the coupler head provides three points of contact with the coupler head giving stability to the train signal light and monitoring equipment. The jaws are V-shaped and are positioned just below the banana shaped arm. The jaws are angled slightly to counteract coupler droop. The pad is positioned at the top of the coupler mount just below the base of the train signal light and monitoring equipment. The jaws and pad arrangement prevent rotation of the train signal light and monitoring equipment.

BRIEF DESCRIPTION OF THE DRAWINGS

The foregoing and other objects, aspects and advantages of the invention will be better understood from the following detailed description of the preferred embodiment with reference to the drawings, in which:

FIG. 1 is a perspective view of a railroad coupler head showing the relief holes in the guard arm side;

FIG. 2 is a side view of the base of the railroad coupler mount showing the swivel toggle in the perpendicular orientation;

FIG. 3 is a plan view of the banana shaped arm and tightening mechanism showing the integral bulge in the arm;

DETAILED DESCRIPTION OF THE PREFERRED EMBODIMENT OF THE INVENTION

Figure 4:
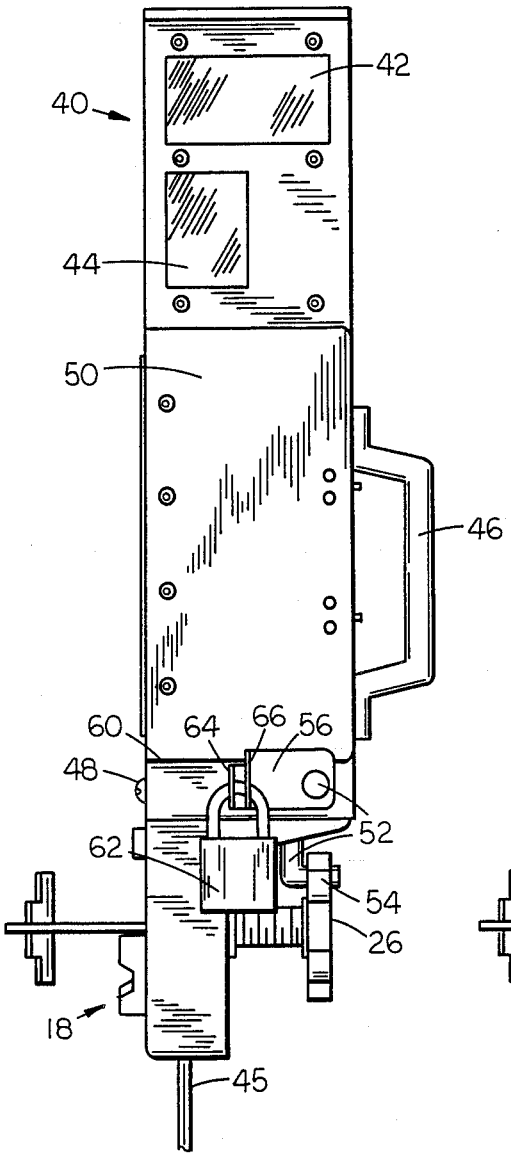
FIG. 4 is a front view of the signalling and monitoring equipment secured to the railroad coupler mount showing the bent first end of the locking bar positioned between the spokes of the tightening knob and a portion of the rotating flange element extending above the bottom edge of the battery compartment door.

Referring now to the drawings and, more particularly, to FIG. 1 there is shown a railroad coupler head 10 which is used for connecting railroad cars together. The coupler head 10 has a guard arm side 12 with four relief holes 14*a*, 14*b*, 16*a*, and 16*b* formed therein. The horizontal pairs of relief holes 14*a* and 14*b*, or 16*a* and 16*b*, are connected such that a banana shaped arm can pass through one relief hole 14*a* or 16*a* and extend out the corresponding relief hole 14*b* or 16*b*. The relief holes 14*a*, 14*b*, 16*a*, and 16*b* are formed when the railroad coupler head 10 is cast and serve to facilitate the casting process as well as lighten the coupler. The coupler head 10 shown in FIG. 1 is just one example of coupler heads used by today's railroads. The improved railroad coupler mount can be used on any railroad coupler which includes relief holes formed in the guard arm side 12 of the coupler head 10.

FIG. 2 shows a side view of the improved railroad coupler mount 18 which includes an arm 20 for extending through a pair of horizontal relief holes in a coupler head and a swivel toggle 22 positioned at a first end of the arm 20. The swivel toggle 22 is designed to pivot on pivot pin 24. The swivel toggle 22 is placed in an in-line orientation with respect to arm 20 when the railroad coupler mount 18 is being installed on or removed from the railroad coupler. To hold the mount 18 on the coupler head after the arm 20 has been passed through the relief holes, the swivel toggle 22 is pivoted to a perpendicular orientation (as shown in FIG. 2) such that the toggle 22 will not pass back through the relief holes in the coupler head. A tightening knob 26 rotates a screw mechanism 28 to withdraw the arm 20 back out of the relief holes to a point at which the perpendicular edges 30 of the swivel toggle 22 are braced against the sidewall of the coupler head. A ridge 32 positioned at the top of the railroad coupler mount 18 provides an area for fastening the train signalling and monitoring equipment.

FIG. 3 shows a detailed plan view of a tightening mechanism which may be used for tightening the railroad coupler mount to the coupler head. The banana shaped arm 20 has a Ushaped cut out 34 that allows the arm 20 to move forward and backward relative to the mount base 36 as the screw 28 is turned by the knob 26. The screw 28 cooperates with threads in the block 35 which is positioned at the top of the cut out 34. The swivel toggle 22 bears against the sidewall of the coupler head as the arm 20 is drawn towards the mount base 36. A bulge 38 in arm 20 is braced against the inside wall of the railroad coupler relief holes upon tightening. U.S. Pat. No. 4,691,563 to Martin shows another tightening mechanism which can be used within the practice of this invention. Some of the improvements over the prior mount disclosed in the patent to Martin include the bulge 38 which allows the mount to be secured with more stability and the swivel toggle 22 which is pivotally attached to the arm 20 and is not easily lost like a separate padlock.

FIG. 4 shows the newly designed end of train signalling and monitoring equipment, shown as equipment box 40, secured to the railroad coupler mount 18. The signalling and monitoring equipment 40 may include a horizontal array of lights 42 and a vertical array of lights 44. In addition, a means to monitor the brake line pressure, shown as hose 45, and telemetry equipment (not shown) can be included. Bolts 48 are used to fasten the equipment box 40 to the railroad coupler mount. Handle 46, secured to the side of the equipment box 40, allows railroad personnel to carry the signalling and monitoring equipment 40 together with the railroad coupler mount 18 as a single unit. A battery compartment door 50 is positioned on the front of the box 40 and allows access to the battery that powers the lights and telemetry equipment.

FIG. 4 shows the locked configuration of the railroad coupler mount 18. A locking bar 52 has a first bent end which interfits between the spokes 54 of the knob 26 in this configuration. The arm 20 is tightened first, then the knob 26 is secured by pivoting the locking bar 52 between the spokes 54 of the knob 26. A rotating flange 56 positioned on the second end of the locking bar 52 serves to lock the battery compartment door 50. The rotating flange 56 has a portion 58 which extends above the base 60 of the battery compartment door 50 in the locked configuration to prevent the door 50 from opening. A padlock 62 is provided for simultaneously locking the battery compartment door 50 and securing the signalling and monitoring equipment 40 to a railroad coupler. The padlock 62 extends through apertures in an outwardly projecting tab 64 and the outwardly projecting side 66 of rotating flange 56. The tab 64 may either be located on the equipment box 40 or the railroad coupler mount 18.

Figure 5:
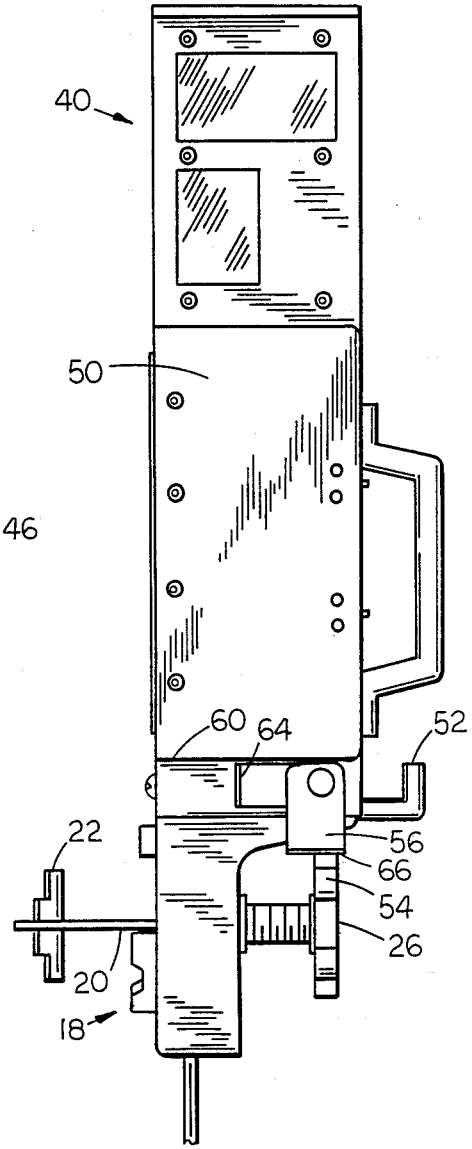
FIG. 5 is a front view of the signalling and monitoring equipment secured to the railroad coupler mount showing the unlocked configuration wherein the bent first end of the locking bar has been pivoted out of engagement with the knob and the rotating flange element no longer extends above the bottom edge of the battery compartment door.

FIG. 5 shows the unlocked configuration of the railroad coupler mount 18. The locking bar 52 is pivoted out from between the spokes 54 of the knob 26 such that the knob 26 can be turned to allow untightening of the arm 20. Once the arm 20 is loosened, the swivel toggle 22 can be pivoted to permit removal of the mount 18 and equipment box 40 from the coupler head. The rotating flange 56 on the second end of the locking bar 52 has been rotated such that the tab 64 and the projecting side 66 are no longer in parallel alignment. In this arrangement, no portion of the rotating flange 56 extends above the base 60 of the battery compartment door 50. The battery compartment door 50 may be freely opened in this configuration. To lock the battery compartment door 50 and lock the mount 18 to a railroad coupler, the locking bar 52 needs only to be pivoted to the position shown in FIG. 4 after the arm 20 has been tightened.

Figure 6:
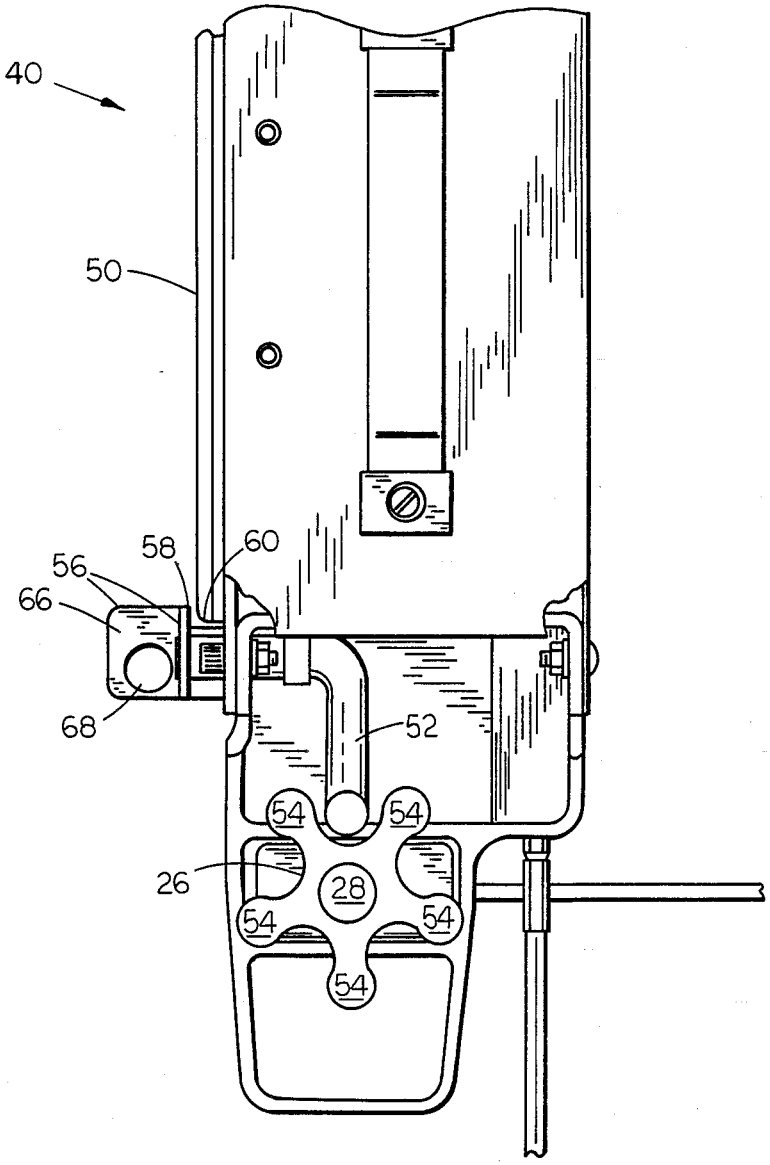
FIG. 6 is a partially cut-away side view of a first side of the signalling and monitoring equipment secured to the railroad coupler mount showing the outwardly projecting side of the rotating flange with an aperture.

FIG. 6 is a partially cut-away side view of the equipment box 40 and mount 18 showing the side which will be furthest from a coupler head. The locking bar 52 is in the locking configuration of FIG. 4. The first bent end of the locking bar 52 interfits between the spokes 54 of knob 26 to prevent the knob 26 from turning. The locking bar 52 extends upwardly and then bends and passes through the wall of the mount 18 to the rotating flange 56. In the locked configuration, a portion 58 of the rotating flange 56 extends above the base 60 of the battery compartment door 50. The outwardly projecting side 66 of the rotating flange has an aperture 68 therethrough which is lined up with an aperture in the outwardly projecting tab. A padlock extends through the apertures to simultaneously lock the battery compartment door 50 and secure the signalling and monitoring equipment 40 to a railroad coupler by preventing the knob 26 from turning screw 28.

Figure 7:
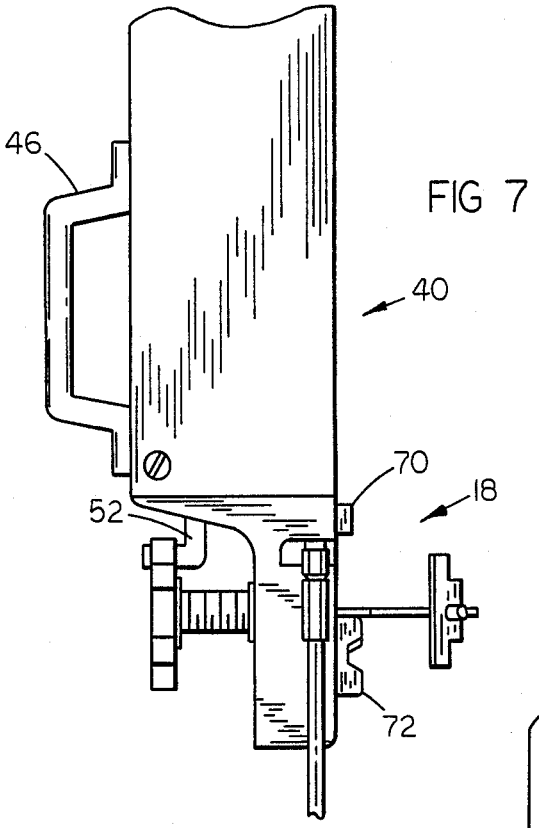
FIG. 7 is a partially cut-away rear view of the signalling and monitoring equipment secured to the railroad coupler mount showing the point at which the locking bar passes through the cast mount base.
Figure 8:
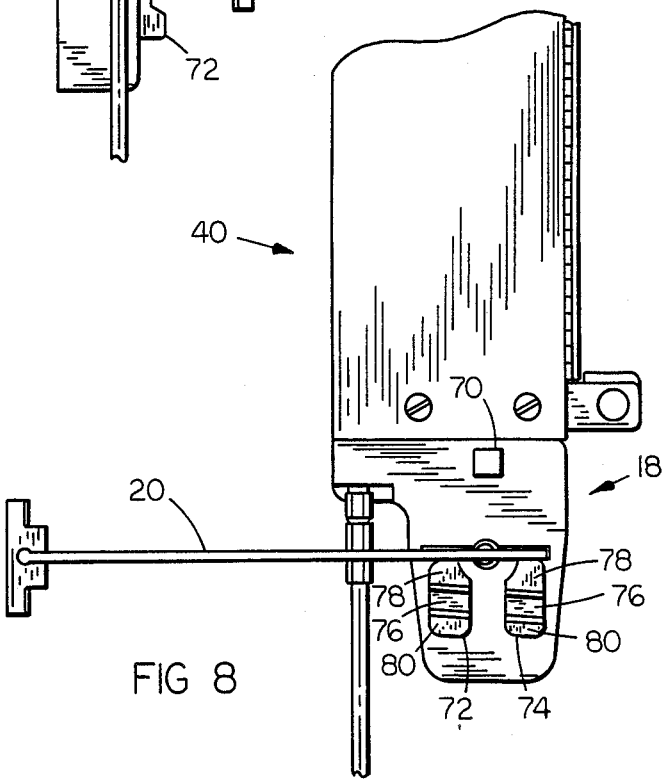
FIG. 8 is a side view of a second side of the signalling and monitoring equipment secured to the railroad coupler mount showing the relationship of the rotating flange to the projecting tab and the V-shaped jaws and pad which contact the sidewall of the coupler head when the signalling and monitoring equipment is mounted thereto

FIG. 7 is a partially cut-away rear view of the signalling and monitoring equipment 40 and railroad coupler mount 18 showing the locking bar 52 in more detail. The locking bar 52 passes through the wall of the coupler mount 18 and is permitted to pivot outwardly in the direction of the handle 46. This view also shows a pad 70 and the left most V-jaw 72 positioned on the side of the coupler mount 18 which will be braced against the coupler head. FIG. 8 is a side view of the equipment box 40 and mount 18 showing the side which will be closest to the coupler head. Referring to both FIGS. 7 and 8, the pad 70 and left and right V-jaws 72 and 74 respectively, cooperate with the sidewall of a coupler head when the mount 18 is fastened thereto. A slot 76 in V-jaws 72 and 74, engages the portion of the coupler head between relief holes 14*a* and 16*a*, shown in FIG. 1 in the guard arm side 12 of the coupler head 10, and projecting portions 78 and 80 project into the relief holes 14*a* and 16*a*, respectively (see FIG. 1). Coupler heads are cast with enough room in the relief holes to allow the top projecting portions 78 and the banana shaped arm 20 to fit in relief hole 14*a*. The V-jaws 72 and 74 prevent rotation of the equipment box 40 and mount 18 in the vertical plane defined by the side shown in FIG. 8. This stabilized mounting prevents undue stress from acting on the banana shaped arm 20 and thereby, prevents the arm 20 from being bent by the stresses created by a moving train. The pad 70 abuts against the sidewall of the coupler head above the relief hole 14*a* when the mount 18 is fastened thereto to provide a three point mounting. The pad 70 and V-jaws 72 and 74 provide for better contact with the sidewall of the coupler head 10 and prevent rotation of the unit on all three axes.

As best seen in FIG. 8, the slot 76 in the two V-jaws 72 and 74 is downward sloping toward the front of the train at an angle of approximately 3 degrees. The slope compensates for coupler droop, thereby keeping the signal lights horizontally pointed down the track.

While the invention has been described in terms of several improvements in the design of a railroad coupler mount including a locking bar which has a specific configuration that allows the simultaneous locking of the battery compartment door and locking of the railroad coupler mount to the railroad coupler, those skilled in the art will recognize that other modifications can be substituted within the spirit and scope of the appended claims

Having thus described my invention, what I claim as new and desire to secure by Letters Patent is as follows:

1. An improved railroad coupler mount for securing signalling and monitoring equipment to the guard arm side of a coupler head, comprising:

a mounting base for supporting said signalling and monitoring equipment;

a banana shaped arm member long enough to extend through a pair of horizontally aligned relief holes in said coupler head and extending from said mounting base, said arm member having first and second ends and a bulge section between said first and second ends for bracing against an inside wall of said coupler head;

a swivel toggle pivotally mounted on said second end of said banana shaped arm member, said swivel toggle being able to pass through said pair of relief holes in an in-line orientation, but preventing the withdrawal of said banana shaped arm when in a perpendicular orientation;

tightening means on said mounting base and connected to said first end of said banana shaped arm member for tightening said mounting base against said coupler head, said swivel toggle bearing against a sidewall said coupler head when said tightening means draws said banana shaped arm towards said mounting base; and stabilizing means on said mounting base for stabilizing said improved railroad coupler mount against rotation in a vertical plane.

2. An improved railroad coupler mount as recited in claim 1 wherein said signalling and monitoring equipment is contained in an equipment box, said equipment box including a battery compartment door for allowing access to a battery, said battery compartment door having a bottom edge, said improved railroad coupler mount further comprising:

locking means on said mounting base for simultaneously locking said battery compartment door of said equipment box and locking said mounting base to said coupler head.

3. An improved railroad coupler mount as recited in claim 2 wherein said tightening means includes a rotatable knob and said locking means comprises:

a locking bar, said locking bar pivotally secured to said mounting base, said locking bar having a bent first end and a second end which terminates at a rotating flange positioned in front of said battery compartment door, said locking bar being pivotable between a locked configuration and an unlocked configuration;

said bent first end of said locking bar being pivotable to a point which prohibits the rotation of said knob in said locked configuration, said bent first end of said locking bar being pivotable to a point which allows free rotation of said knob in said unlocked configuration; and said rotating flange rotatable to a position which prevents said battery compartment door from opening in said locked configuration, said rotating flange rotatable to a position which allows said battery compartment door to swing open in said unlocked configuration.

4. An improved railroad coupler mount as recited in claim 3 further comprising:

a lock for locking said rotating, flange to a tab projecting from said mounting base, said tab and said rotating flange having apertures which are aligned when said flange is positioned in said locked configuration, said lock extending through said aligned apertures in said locked configuration.

5. An improved railroad coupler mount as recited in claim 2 further comprising:

releasable fastening means for fastening said equipment box to said improved railroad coupler mount and for allowing removal of said equipment box from said improved railroad coupler mount.

6. An improved railroad coupler mount as recited in claim 5 wherein said releasable fastening means comprises a plurality of nuts and bolts, said nuts and bolts being positioned to extend through apertures in said equipment box and said mounting base.

7. An improved railroad coupler mount as recited in claim 1 wherein said tightening means comprises a knob attached to a screw member threadably engaging a block, said block being attached to said first end of said banana shaped arm.

8. An improved railroad coupler mount as recited in claim 1 wherein said stabilizing means comprises V-shaped jaw members and a pad positioned on a side of said mounting base which engages the guard arm side of a coupler head, said V-shaped jaw members having projecting portions for projecting in a pair of vertically aligned relief holes in said coupler head, said pad for abutting against said sidewall of said coupler head and providing a three point mounting with said V-jaws.

9. An improved railroad coupler mount for securing signalling and monitoring equipment to the guard arm side of a coupler head, comprising:

a mounting base for supporting said signalling and monitoring equipment, said signalling and monitoring equipment being contained in an equipment box releasably fastened to said mounting base and having a compartment door for allowing access to a component positioned inside said equipment box;

a banana shaped arm member long enough to extend through a pair of horizontally aligned relief holes in said coupler head and extending from said mounting base;

a swivel toggle pivotally mounted on said banana shaped arm; and locking means connected to said mounting base for simultaneously locking said compartment door of said equipment box and locking said mounting base to said coupler head.

10. An improved railroad coupler mount as recited in claim 9 wherein said locking means comprises:

a locking bar having a bent first end and a second end which terminates at a rotating flange positioned in front of said compartment door, said locking bar being pivotable between a locked configuration and an unlocked configuration, said bent first end of said locking bar being pivoted to a point which prohibits the rotation of a tightening knob in said locked configuration, but allowing free rotation of said tightening knob in said unlocked configuration, said rotating flange rotating to a position which prevents said compartment door from opening in said locked configuration, but allows said compartment door to swing open in said unlocked configuration.

11. An improved railroad coupler mount as recited in claim 10 further comprising a lock for locking said rotating flange to a tab projecting from said mounting base, said tab and said rotating flange having apertures which are aligned when said flange is positioned in said locked configuration, said lock extending through said aligned apertures in said locked configuration.

* * * * *